US009884242B2

(12) United States Patent
Kleinert

(10) Patent No.: US 9,884,242 B2
(45) Date of Patent: Feb. 6, 2018

(54) GLOVE WITH EXPANSION ZONES ALONG SIDES OF FINGERS

(75) Inventor: James M. Kleinert, Turners Station, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 1070 days.

(21) Appl. No.: 13/558,741

(22) Filed: Jul. 26, 2012

(65) Prior Publication Data

US 2014/0026281 A1 Jan. 30, 2014

(51) Int. Cl.
*A63B 71/14* (2006.01)
*A41D 19/015* (2006.01)

(52) U.S. Cl.
CPC ..... *A63B 71/146* (2013.01); *A41D 19/01523* (2013.01); *A41D 19/01582* (2013.01); *A63B 71/141* (2013.01); *A63B 2209/10* (2013.01)

(58) Field of Classification Search
CPC ..... A41D 19/00; A41D 19/015; A41D 19/01523; A63B 71/141; A63B 71/143; A63B 71/146
USPC ..... 2/19, 20, 159, 161.1, 161.2, 163
See application file for complete search history.

(56) References Cited

U.S. PATENT DOCUMENTS

| | | | |
|---|---|---|---|
| 325,968 | A | 9/1885 | Rawlings |
| 385,728 | A | 7/1888 | Sauer |
| 482,647 | A | 9/1892 | Obear |
| RE12,996 | E | 7/1909 | Peach |
| 1,018,271 | A | 2/1912 | Rogers |
| 1,202,705 | A | 10/1916 | Goldsmith et al. |
| 1,435,478 | A | 11/1922 | Kennedy |
| 1,436,131 | A | 11/1922 | Whitley |
| 1,496,824 | A | 6/1924 | Nixon, Jr. |
| 1,525,298 | A | 2/1925 | Hartman |
| 1,552,080 | A | 9/1925 | Rainey |
| 1,562,176 | A | 11/1925 | Latina |
| RE16,272 | E | 2/1926 | Green |
| 1,594,304 | A | 7/1926 | Klahn et al. |
| D72,069 | S | 2/1927 | Meyers |
| 1,716,221 | A | 6/1929 | Fernie |
| 1,841,193 | A | 1/1932 | Lidston |

(Continued)

FOREIGN PATENT DOCUMENTS

| | | |
|---|---|---|
| CA | 2288593 | 5/2000 |
| CA | 2683608 | 4/2010 |

(Continued)

OTHER PUBLICATIONS

Knecht, Petra: "Funktionstextilien" 2003, Deutscher Fachverlag GMBH, Frankfurt AM Main, XP002473095, pp. 62,63 and pp. 282, 283.

(Continued)

*Primary Examiner* — Danny Worrell
(74) *Attorney, Agent, or Firm* — Middleton Reutlinger; Alexander P. Brackett; Robert H. Eichenberger

(57) ABSTRACT

A glove, particularly for golf, is provided with a gusset of expandable material which extends along the finger stalls of the glove from the web between the finger stalls to a selected distance from the distal end of the fingers, the glove having a non-expandable material wrap around the fingers thereby providing an expansion zone that extends along the length of the fingers to a selected distance from the tip end of the distal phalanxes of the fingers.

8 Claims, 6 Drawing Sheets

(56) References Cited

U.S. PATENT DOCUMENTS 1,900,395 A 3/1933 Gitt
2,036,413 A 4/1936 Herbruck
2,083,935 A 6/1937 Arnold
2,258,999 A 10/1941 Nunn
2,344,080 A 3/1944 Burgett
2,369,115 A 2/1945 Bloom
2,465,136 A 3/1949 Troccoli
2,528,802 A 11/1950 Turner
2,558,544 A 6/1951 Delsalle
2,567,489 A 9/1951 Lewis
2,636,172 A 4/1953 Stobbe
2,750,594 A 6/1956 Denkert
2,975,429 A 3/1961 Newman
2,980,915 A 4/1961 Peterson
3,042,929 A 7/1962 Kobos
3,096,523 A 7/1963 Bruchas
3,164,841 A 1/1965 Burtoff
3,175,226 A 3/1965 Weinberg
3,273,165 A 9/1966 Sperandeo
3,290,695 A 12/1966 Burtoff
3,300,787 A 1/1967 Denkert
3,411,222 A 11/1968 Williams
D213,287 S 2/1969 Khazzam
3,458,867 A 8/1969 Moore et al.
3,532,344 A 10/1970 Masstab
3,564,613 A 2/1971 Fowler
3,576,036 A 4/1971 Latina
3,588,915 A 6/1971 Latina
3,597,765 A * 8/1971 Stanton ..... 2/161.3
3,605,117 A 9/1971 Latina
3,606,614 A 9/1971 Dimitroff
3,649,966 A 3/1972 Shields
3,707,730 A 1/1973 Slider
3,918,096 A 11/1975 Lim
D240,671 S 7/1976 McTear
D240,672 S 7/1976 McTear
3,997,922 A 12/1976 Huhta
3,997,992 A 12/1976 Anderson
4,027,339 A 6/1977 Brucker
4,038,787 A 8/1977 Bianchi
4,042,975 A 8/1977 Elliott, Jr. et al.
4,051,552 A 10/1977 Widdemer
4,051,553 A 10/1977 Howard
4,067,063 A 1/1978 Ettinger
4,068,312 A 1/1978 Ledesma
4,084,584 A 4/1978 Detty
4,095,292 A 6/1978 Klein
D248,898 S 8/1978 Deleone et al.
4,137,572 A 2/1979 Jansson et al.
4,176,839 A 12/1979 Pinkus
4,187,557 A 2/1980 Tombari
4,201,203 A 5/1980 Applegate
4,250,578 A 2/1981 Barlow
4,262,800 A 4/1981 Nethercutt
4,272,849 A 6/1981 Thurston et al.
4,272,850 A 6/1981 Rule
4,287,885 A 9/1981 Applegate
4,300,567 A 11/1981 Kolenik et al.
4,329,741 A 5/1982 Bach
4,346,481 A 8/1982 Latina
4,438,532 A 3/1984 Campanella et al.
4,445,507 A 5/1984 Eisenberg
4,446,970 A 5/1984 Further
4,524,464 A 6/1985 Primiano et al.
4,546,495 A 10/1985 Castillo
4,561,122 A * 12/1985 Stanley et al. ..... 2/20
4,570,269 A 2/1986 Berlese
4,589,146 A 5/1986 Taylor
4,590,625 A 5/1986 Keim
4,630,318 A 12/1986 Aoki
4,663,783 A 5/1987 Obayashi
4,665,561 A 5/1987 Aoki
4,677,698 A 7/1987 Angas
4,684,123 A 8/1987 Fabry
4,691,387 A 9/1987 Lopez
4,700,404 A 10/1987 Potvin
D294,984 S 3/1988 Green
4,747,163 A 5/1988 Dzierson
4,748,690 A 6/1988 Webster
4,751,749 A 6/1988 Cowhey
4,766,612 A 8/1988 Patton, Sr.
4,815,147 A 3/1989 Gazzano et al.
4,843,651 A * 7/1989 Gramza et al. ..... 2/161.1
4,847,915 A 7/1989 Keene
4,850,053 A 7/1989 Tepley et al.
4,864,659 A 9/1989 Morris
4,864,660 A 9/1989 Sawyer
4,886,071 A 12/1989 Mehl et al.
4,891,845 A 1/1990 Hayes
4,896,376 A 1/1990 Miner
4,911,433 A 3/1990 Walker et al.
4,930,162 A 6/1990 Côté
4,954,239 A 9/1990 Mueller
4,958,384 A 9/1990 McCrane
4,967,418 A 11/1990 Marcotte
5,004,227 A 4/1991 Hoffman
5,016,286 A 5/1991 Henriksen
5,028,050 A 7/1991 Freyer
5,031,238 A 7/1991 Hayes
D320,871 S 10/1991 Bothof, III et al.
D320,872 S 10/1991 McCrane
5,058,209 A 10/1991 Eisenberg
5,058,573 A 10/1991 Hess et al.
5,067,175 A 11/1991 Gold
5,083,361 A 1/1992 Rudy
5,107,544 A 4/1992 Capatosto
5,117,981 A 6/1992 Crawford et al.
D328,369 S 7/1992 Hong
5,136,725 A 8/1992 Montero
5,146,624 A 9/1992 Brückner
5,168,576 A 12/1992 Krent et al.
5,168,578 A 12/1992 Stanley
D332,845 S 1/1993 Johnston
5,175,886 A 1/1993 Suk
5,195,188 A 3/1993 Bourdeau et al.
5,214,799 A 6/1993 Fabry
5,218,718 A 6/1993 Chih
5,218,719 A 6/1993 Johnson
D338,280 S 8/1993 Krent et al.
5,237,703 A 8/1993 Brine et al.
5,253,365 A 10/1993 Clevenhagen
5,257,418 A 11/1993 Jaskiewicz
5,309,573 A 5/1994 Solar et al.
5,323,490 A 6/1994 Yarbrough
5,328,652 A 7/1994 Thomson
5,329,639 A 7/1994 Aoki
5,330,391 A 7/1994 Mitchell
D351,050 S 9/1994 Sheldon
5,345,609 A 9/1994 Fabry et al.
5,379,460 A 1/1995 Aoki
D356,203 S 3/1995 Mitch
D360,284 S 7/1995 Paffett et al.
5,435,008 A 7/1995 Shane
5,442,815 A 8/1995 Cordova et al.
5,442,816 A 8/1995 Seketa
D362,927 S 10/1995 McCrane
5,459,878 A 10/1995 Gold
5,462,280 A 10/1995 Dickerson
5,471,682 A 12/1995 Robins et al.
5,477,558 A 12/1995 Völker et al.
5,488,739 A 2/1996 Cardinal
5,490,290 A 2/1996 Gold
D367,731 S 3/1996 Estwanik
5,500,955 A 3/1996 Gongea
5,511,242 A 4/1996 Bianchi
5,511,243 A 4/1996 Hall et al.
5,511,244 A 4/1996 Shikatani
5,520,041 A 5/1996 Haswell
5,530,967 A 7/1996 Cielo
5,551,083 A 9/1996 Goldsmith
5,557,803 A 9/1996 Granich et al.
5,557,806 A 9/1996 Caswell et al.
5,564,122 A 10/1996 Wagner
5,569,225 A 10/1996 Fleury

(56) References Cited

U.S. PATENT DOCUMENTS 5,575,005 A 11/1996 Walker et al.
5,581,809 A 12/1996 Mah
5,592,688 A 1/1997 LaRonge et al.
D378,148 S 2/1997 Haney
5,598,582 A 2/1997 Andrews et al.
5,600,853 A 2/1997 Yewer, Jr.
5,608,912 A 3/1997 Cumberland
5,608,915 A 3/1997 Libit
5,634,214 A 6/1997 St. Ville
5,638,548 A 6/1997 Kawakami
5,640,712 A 6/1997 Hansen et al.
5,644,795 A 7/1997 Landis et al.
5,655,221 A 8/1997 Worischeck
5,655,226 A 8/1997 Williams
5,659,897 A 8/1997 Satoh
5,672,151 A 9/1997 Calderon-Garciduenas
D385,667 S 10/1997 Goldsmith et al.
5,675,839 A 10/1997 Gordon et al.
5,678,245 A 10/1997 Rector et al.
5,682,613 A 11/1997 Dinatale
5,685,014 A 11/1997 Dapsalmon
5,692,242 A 12/1997 Tekerman et al.
5,694,642 A 12/1997 Rector et al.
5,697,103 A 12/1997 Wiggins
5,697,104 A 12/1997 Welton
D389,283 S 1/1998 Goldsmith et al.
5,706,521 A 1/1998 Haney
5,708,979 A 1/1998 Redwood et al.
5,715,539 A 2/1998 Benecki et al.
5,717,994 A 2/1998 Goldsmith
5,717,995 A 2/1998 Murai
5,720,047 A 2/1998 Spitzer
5,725,566 A 3/1998 Pioger et al.
5,728,071 A 3/1998 Watson et al.
5,738,641 A 4/1998 Watson et al.
5,745,916 A 5/1998 Linner
5,761,745 A 6/1998 Sato
5,778,449 A 7/1998 Oetting et al.
5,781,929 A 7/1998 Shikatani
5,781,931 A 7/1998 Lee
5,785,617 A 7/1998 MacKay, Jr.
5,787,506 A 8/1998 Wilder et al.
5,790,980 A 8/1998 Yewer, Jr.
5,792,102 A 8/1998 Muller-Spath
5,799,327 A 9/1998 Clevenhagen
5,802,614 A 9/1998 Melone, Jr.
5,806,092 A 9/1998 Shikatani
5,809,571 A 9/1998 Spitzer
5,815,839 A 10/1998 Safford
5,815,840 A 10/1998 Hamlin
5,819,312 A 10/1998 Snyder et al.
5,819,313 A 10/1998 McCrane
5,855,022 A 1/1999 Storto
5,878,436 A 3/1999 Jones
5,884,329 A 3/1999 Goldsmith et al.
5,887,282 A 3/1999 Lenhart
5,893,172 A 4/1999 Haynes et al.
5,898,938 A 5/1999 Baylor et al.
5,898,942 A 5/1999 Anderson
5,926,847 A 7/1999 Eibert
5,946,720 A 9/1999 Sauriol
5,963,985 A 10/1999 Behr et al.
5,983,396 A 11/1999 Morrow et al.
5,987,642 A 11/1999 Webster
5,987,646 A 11/1999 Bolmer
D417,757 S 12/1999 Aoki
5,996,117 A 12/1999 Goldsmith et al.
6,000,059 A 12/1999 Abts
6,006,751 A 12/1999 Spitzer
6,012,170 A 1/2000 Kim
6,016,571 A 1/2000 Guzman et al.
D420,173 S 2/2000 Aoki
D420,174 S 2/2000 Aoki
D420,202 S 2/2000 Redwood et al.
6,035,443 A 3/2000 Green
6,041,438 A 3/2000 Kirkwood
6,049,910 A 4/2000 McCarter
6,052,827 A 4/2000 Widdemer
6,065,150 A 5/2000 Huang
6,065,659 A 5/2000 Faz
D426,922 S 6/2000 Redwood et al.
6,085,352 A 7/2000 Martin
6,088,835 A 7/2000 Perkins et al.
6,098,200 A 8/2000 Minkow et al.
6,105,162 A 8/2000 Douglas et al.
6,119,267 A 9/2000 Pozzi
6,122,769 A 9/2000 Wilder et al.
D431,691 S 10/2000 Redwood et al.
6,159,243 A 12/2000 Schouwenburg
6,182,289 B1 2/2001 Brown
6,185,747 B1 2/2001 Hughes
6,206,871 B1 3/2001 Zanon et al.
6,216,276 B1 * 4/2001 Eibert ..... 2/161.2
6,223,350 B1 5/2001 McFarlane
6,223,744 B1 5/2001 Garon
6,226,795 B1 5/2001 Winningham
6,233,744 B1 5/2001 McDuff
6,249,915 B1 6/2001 Hang
6,253,382 B1 7/2001 Kleinert
6,256,792 B1 7/2001 MacDonald
6,264,619 B1 7/2001 Ferguson
D445,996 S 8/2001 Kiernan
6,275,996 B1 8/2001 Redwood et al.
6,279,160 B1 8/2001 Chen
6,279,163 B1 8/2001 Hale et al.
6,289,515 B1 9/2001 Fous
6,289,516 B1 9/2001 Motooka et al.
6,321,387 B1 11/2001 Fukae
6,341,376 B1 1/2002 Smerdon, Jr.
6,353,931 B1 3/2002 Gilligan et al.
6,378,925 B1 4/2002 Greenlee
6,389,601 B2 5/2002 Kleinert
6,405,380 B1 6/2002 Kuroda et al.
6,415,444 B1 7/2002 Kleinert
6,415,445 B1 7/2002 Nishijima et al.
D461,621 S 8/2002 Bevier
6,427,247 B1 8/2002 Suk
6,430,745 B2 8/2002 Murai
D462,922 S 9/2002 Yuan et al.
6,453,474 B2 9/2002 Kleinert
D464,178 S 10/2002 Redwood et al.
6,460,184 B1 10/2002 Nishimura et al.
6,487,724 B1 12/2002 Aoki
D468,075 S 1/2003 Votel
6,502,244 B1 1/2003 Kleinert
6,502,699 B1 1/2003 Watson
6,516,470 B1 2/2003 Aoki
6,516,471 B1 2/2003 Baumann
6,519,781 B1 2/2003 Berns
D471,343 S 3/2003 Sun
D471,674 S 3/2003 Redwood et al.
6,526,592 B1 3/2003 Best
6,536,046 B1 3/2003 Gilligan
6,543,058 B2 4/2003 Litke
6,553,576 B1 4/2003 Knapp
D474,863 S 5/2003 Sun
D474,963 S 5/2003 Gersten et al.
6,571,394 B1 6/2003 Hackett et al.
6,584,616 B2 7/2003 Godshaw et al.
6,618,860 B1 9/2003 Sullivan et al.
6,651,255 B1 11/2003 Schild
6,662,942 B1 12/2003 Bonzagni
6,668,379 B2 12/2003 Kleinert
6,681,402 B1 1/2004 Bevier et al.
6,701,530 B2 3/2004 Kleinert
6,704,939 B2 3/2004 Faulconer
6,708,346 B2 3/2004 Terris et al.
6,715,152 B2 4/2004 Mazzarolo
6,721,960 B1 4/2004 Levesque et al.
6,732,377 B1 5/2004 Wilkinson
6,745,402 B2 6/2004 Caswell
6,760,923 B1 7/2004 Tate
6,760,924 B2 7/2004 Hatch et al.
D495,097 S 8/2004 Redwood et al.

(56) References Cited

U.S. PATENT DOCUMENTS

| | | | | |
|---|---|---|---|---|
| 6,775,847 | B2 | 8/2004 | Terris et al. | |
| D499,529 | S | 12/2004 | Kleinert | |
| D499,856 | S | 12/2004 | Kleinert | |
| 6,832,391 | B1 | 12/2004 | Bower | |
| 6,845,514 | B1 | 1/2005 | Yao | |
| 6,845,519 | B2 | 1/2005 | Garneau | |
| 6,851,123 | B1 | 2/2005 | Kleinert | |
| 6,862,744 | B2 | 3/2005 | Kuroda et al. | |
| 6,868,553 | B2 | 3/2005 | Kleinert | |
| 6,889,389 | B2 | 5/2005 | Kleinert | |
| 6,895,598 | B1 * | 5/2005 | Sokolowski | 2/159 |
| 6,961,960 | B2 | 11/2005 | Gold et al. | |
| D513,828 | S | 1/2006 | Bevier | |
| D514,772 | S | 2/2006 | Bevier | |
| 7,000,253 | B1 | 2/2006 | Kleinert | |
| 7,000,256 | B2 | 2/2006 | Kleinert | |
| 7,000,257 | B2 | 2/2006 | Bevier | |
| 7,003,806 | B1 | 2/2006 | Kleinert et al. | |
| D516,277 | S | 3/2006 | Mattesky | |
| D527,149 | S | 8/2006 | Bonzagni et al. | |
| D529,236 | S | 9/2006 | Litke et al. | |
| 7,100,212 | B2 | 9/2006 | Jaeger | |
| D529,665 | S | 10/2006 | Litke et al. | |
| D532,162 | S | 11/2006 | Bonzagni et al. | |
| 7,171,696 | B2 | 2/2007 | Falone et al. | |
| D545,002 | S | 6/2007 | Voravan | |
| D549,398 | S | 8/2007 | Swartz et al. | |
| D549,886 | S | 8/2007 | Kleinert | |
| D551,395 | S | 9/2007 | Clark | |
| 7,275,268 | B2 | 10/2007 | Gait | |
| D554,808 | S | 11/2007 | Litke et al. | |
| 7,353,544 | B1 | 4/2008 | Kleinert | |
| D569,556 | S | 5/2008 | Cooper et al. | |
| D570,056 | S | 5/2008 | Metcalf | |
| 7,406,719 | B2 | 8/2008 | Aoki | |
| D581,102 | S | 11/2008 | Faulconer | |
| D583,527 | S | 12/2008 | Kleinert | |
| D583,528 | S | 12/2008 | Kleinert | |
| 7,464,446 | B2 | 12/2008 | Johansson | |
| D584,026 | S | 1/2009 | Kleinert | |
| D584,027 | S | 1/2009 | Kleinert | |
| D595,456 | S | 6/2009 | Kleinert | |
| D595,457 | S | 6/2009 | Kleinert | |
| D595,458 | S | 6/2009 | Kleinert | |
| D595,904 | S | 7/2009 | Kleinert | |
| D597,728 | S | 8/2009 | Kleinert | |
| D597,729 | S | 8/2009 | Kleinert | |
| D597,730 | S | 8/2009 | Kleinert | |
| D598,636 | S | 8/2009 | Kleinert | |
| 7,578,006 | B2 | 8/2009 | Garneau | |
| D599,960 | S | 9/2009 | Ash et al. | |
| D604,027 | S | 11/2009 | Kleinert | |
| D612,576 | S | 3/2010 | Toth | |
| 7,707,653 | B2 | 5/2010 | Kleinert | |
| D617,977 | S | 6/2010 | Toth | |
| 7,895,669 | B2 | 3/2011 | Kleinert | |
| 7,895,670 | B2 | 3/2011 | Kleinert | |
| 7,908,672 | B2 * | 3/2011 | Butler | 2/162 |
| D637,765 | S | 5/2011 | Singh | |
| 7,937,773 | B1 | 5/2011 | Kleinert | |
| D640,856 | S | 7/2011 | Rose | |
| RE42,729 | E | 9/2011 | Kleinert | |
| D651,408 | S | 1/2012 | Farkas | |
| 8,096,901 | B2 | 1/2012 | Russotti | |
| 8,104,098 | B1 | 1/2012 | Kleinert | |
| 8,196,219 | B2 * | 6/2012 | Roeckl | 2/16 |
| D699,640 | S | 10/2012 | Kleinert | |
| 8,276,215 | B2 | 10/2012 | Merkle et al. | |
| D680,276 | S | 4/2013 | Kleinert | |
| 8,966,666 | B2 * | 3/2015 | Faulconer | 2/161.1 |
| 2001/0025382 | A1 | 10/2001 | Murai | |
| 2001/0054190 | A1 | 12/2001 | Kleinert | |
| 2002/0013961 | A1 | 2/2002 | Kleinert | |
| 2002/0040494 | A1 | 4/2002 | Kleinert | |
| 2002/0042940 | A1 | 4/2002 | Kuroda et al. | |
| 2002/0152536 | A1 | 10/2002 | Kuroda et al. | |
| 2003/0005506 | A1 | 1/2003 | Litke | |
| 2003/0050586 | A1 | 3/2003 | Domanski et al. | |
| 2003/0051285 | A1 | 3/2003 | Bower | |
| 2003/0056273 | A1 | 3/2003 | Kleinert | |
| 2003/0061651 | A1 | 4/2003 | DeRose, Sr. | |
| 2003/0205232 | A1 | 11/2003 | Spitzer | |
| 2004/0016038 | A1 | 1/2004 | Motooka et al. | |
| 2004/0025226 | A1 | 2/2004 | Jaeger | |
| 2004/0025227 | A1 | 2/2004 | Jaeger | |
| 2004/0103465 | A1 | 6/2004 | Kleinert | |
| 2004/0107476 | A1 | 6/2004 | Goldwitz | |
| 2004/0111786 | A1 | 6/2004 | Terris et al. | |
| 2004/0123371 | A1 | 7/2004 | Bryant, Sr. | |
| 2004/0216207 | A1 | 11/2004 | Anderson | |
| 2004/0221365 | A1 | 11/2004 | Fitzgerald | |
| 2005/0034213 | A1 | 2/2005 | Bamber | |
| 2005/0114982 | A1 | 6/2005 | Gremmert | |
| 2006/0026738 | A1 | 2/2006 | Kleinert | |
| 2006/0137067 | A1 | 6/2006 | Wu | |
| 2006/0195968 | A1 | 9/2006 | Powell et al. | |
| 2007/0061943 | A1 * | 3/2007 | Kleinert | A41D 19/00 2/159 |
| 2007/0083968 | A1 | 4/2007 | Stokes | |
| 2007/0150998 | A1 | 7/2007 | Atherton | |
| 2007/0150999 | A1 | 7/2007 | Brown | |
| 2007/0209097 | A1 | 9/2007 | Iacullo | |
| 2007/0226873 | A1 | 10/2007 | Mattesky | |
| 2008/0052799 | A1 | 3/2008 | Yoo | |
| 2008/0060115 | A1 | 3/2008 | Morris | |
| 2008/0141435 | A1 | 6/2008 | Friedman | |
| 2008/0263745 | A1 | 10/2008 | Grilliot et al. | |
| 2009/0139010 | A1 | 6/2009 | Bevier | |
| 2009/0320178 | A1 | 12/2009 | Faulconer | |
| 2012/0017351 | A1 * | 1/2012 | McCrane | 2/161.1 |
| 2012/0131715 | A1 | 5/2012 | Copeland et al. | |
| 2012/0131716 | A1 | 5/2012 | Copeland et al. | |
| 2012/0227157 | A1 * | 9/2012 | Kleinert | 2/161.1 |
| 2012/0227158 | A1 | 9/2012 | Ashworth et al. | |

FOREIGN PATENT DOCUMENTS

| | | |
|---|---|---|
| GB | 710394 | 6/1954 |
| JP | 401171849 | 7/1989 |
| JP | 09182825 | 7/1997 |
| JP | 02003020504 | 1/2003 |
| WO | WO-9716085 | 5/1997 |
| WO | WO9827837 | 7/1998 |
| WO | WO-03082036 | 10/2003 |

OTHER PUBLICATIONS

United States Patent and Trademark Office (ISA/US); International Search Report of the International Searching Authority; dated Apr. 23, 2003; pp. 1-3; PCT/US02/19390; U.S. Patent and Trademark Office; USA.

United States Patent and Trademark Office (ISA/US); International Search Report of the International Searching Authority; dated Apr. 7, 2005; pp. 1-3; PCT/US03/41488; U.S. Patent and Trademark Office; USA.

European Patent Office; International Search Report and Written Opinion of the International Searching Authority, or the Declaration; International Search Report and Written Opinion for PCT/US2012/027821; dated Jun. 29, 2012; pp. 1-8; European Patent Office, the Netherlands.

Anonymous: "Sportco Source" Internet Article, [Online] Apr. 27 2006 (Apr. 27, 2006), XP002473014, Retrieved from the Internet: URL: http://web.archive.org/web/20060427131931/http://www.sportco-int.com/baseballgloves.htm> [retrieved on Mar. 17, 2008], p. 9.

Anonymous: "The Coolmax Golf Glove", Internet Article, [Online] Aug. 29, 2006 (Aug. 29, 2006), XP002473015, Retrieved from the Internet: URL: http://web.archive.org/web/20060829123241/http://www.hsc.csu.edu.au/textiles_design/performance/2795/glove.htm> [retrieved on Mar. 17, 2008] the whole document.

(56) References Cited

OTHER PUBLICATIONS

European Patent Office (ISA/EP); International Search Report and Written Opinion of the International Searching Authority, or the Declaration; dated Apr. 10, 2008; pp. 1-20; PCT/US2007/023054; European Patent Office; the Netherlands.
United States Patent and Trademark Office (ISA/US); International Search Report and Written Opinion of the International Searching Authority, or the Declaration; dated May 9, 2005; pp. 1-8; PCT/US04/31316; U.S. Patent and Trademark Office; USA.
European Patent Office (ISA/EP); International Search Report and Written Opinion of the International Searching Authority, or the Declaration; dated Apr. 13, 2007; pp. 1-8; PCT/US2006/038290; European Patent Office; the Netherlands.
European Patent Office (ISA/EP); International Search Report and Written Opinion of the International Searching Authority, or the Declaration; dated Jan. 23, 2008; pp. 1-12; PCT/US2007/017302; European Patent Office; the Netherlands.
United States Patent and Trademark Office (ISA/US); International Search Report of the International Searching Authority; dated Jul. 17, 2003; pp. 1-5; PCT/US03/09409; U.S. Patent and Trademark Office; USA.
European Patent Office (ISA/EP); International Search Report; dated Jun. 22, 2001; pp. 1-3; PCT/US2001/02608; European Patent Office; the Netherlands.

* cited by examiner

GLOVE WITH EXPANSION ZONES ALONG SIDES OF FINGERS

BACKGROUND OF THE INVENTION (a) Field of the Invention

This invention relates to gloves for the human hand which are particularly useful in participating in activities which require a snug fit of the glove at the distal end of the fingers. More particularly, this invention relates to a glove specifically designed to provide expandable zones along the lateral sides of the finger stalls of the gloves just distal to the proximal interphalangeal joints of the fingers thereby allowing a glove to expand at the proximal interphalangeal joints providing a snug fit at the distal ends of the fingers.

(b) Description of Related Art

Glove construction for protection of the human hand is well known. Moreover, there are a number of patents which teach gloves and glove construction useful for specific sporting activities, as well as work gloves, dress gloves and the like. For example, U.S. Pat. No. 3,175,226 teaches a glove construction with selected portions of the glove including expansion zones to accommodate hands of different sizes, as well as enlargement of selected areas when bending and flexing the fingers of the wearer. This reference teaches leather or a relatively inelastic palmar side section and an elastic dorsal side section with outwardly extending finger and thumb stalls. The longitudinally extending edges or sides along the finger stalls include an expansion zone of knitted material which extends from the web between the index finger stall and the thumb stall along the entire length of the index finger.

Moreover, for example, U.S. Pat. No. 5,195,188 teaches a golf glove wherein the longitudinal extending areas along the sides of the finger stalls of the glove are made of a material possessing only slight extensibility, such as leather, and the other areas of the finger stalls are made of an extensible, elastic material.

Although, hand protection from direct shock and abrasions is found in gloves of the present art, what is needed is a glove which provides improved grip, comfort and performance by providing a glove with finger stalls which expand at the proximal interphalangeal joint providing with a snug fit at the distal ends of the fingers.

SUMMARY OF THE INVENTION

It is an object of the present invention to provide a glove which allows expansion at the proximal interphalangeal joints of the fingers and a snug fit at the distal ends of the fingers.

Another object of the present invention is to provide a golf glove having materials of construction in preselected areas of contact with the fingers of the human hand to provide a snug fit glove for the use in gripping the handle of a golf club.

A further object of the present invention is to provide a golf glove having expansion materials extending along the finger stalls of the glove from the web between the finger stalls to a selected distance from the distal end of the fingers.

More particularly, the present invention provides a glove having a gusset of expandable material extending in a web of the glove between adjacent finger stalls and positioned to terminate between the proximal interphalangeal joints and the distal interphalangeal joints of fingers to be received in adjacent finger stalls.

Further objects and advantages of this invention will appear from the following description and appended claims.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
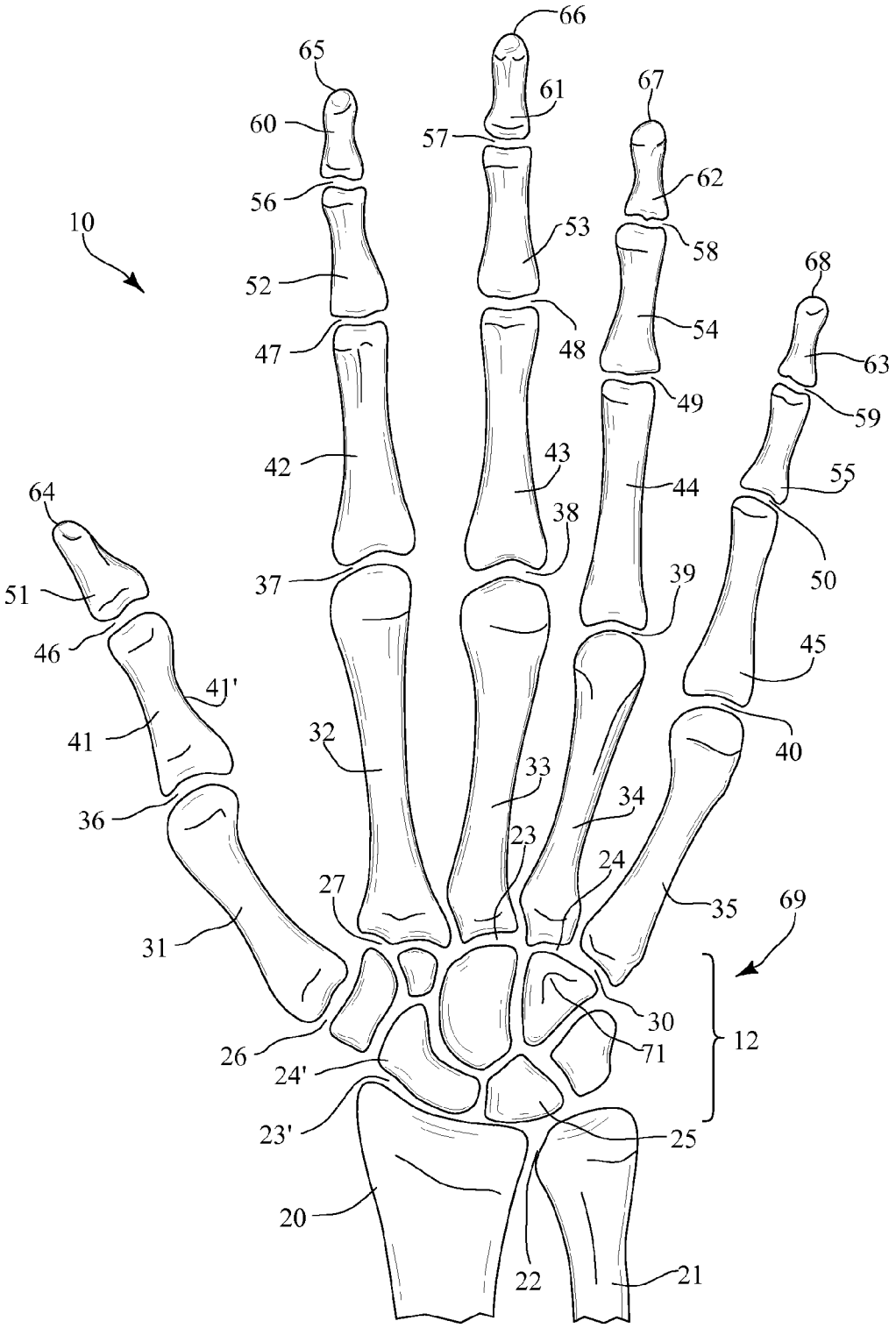
FIG. 1 is a bottom schematic anatomical view of the bones of the left side human hand showing the palmar-side details.

FIG. 1 is a schematic anatomical view of the bones of a left human hand 10 looking at a palm side. Shown are the radius 20, ulna 21, radiocarpal joint (RC) 23', distal radio ulnar joint (DRUJ) 22, wrist 12, thumb 64, index finger 65, long finger 66, ring finger 67, small finger 68, and the carpus 69. The carpus 69 comprises eight carpal bones, seven of which are shown in FIG. 1, and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 2:
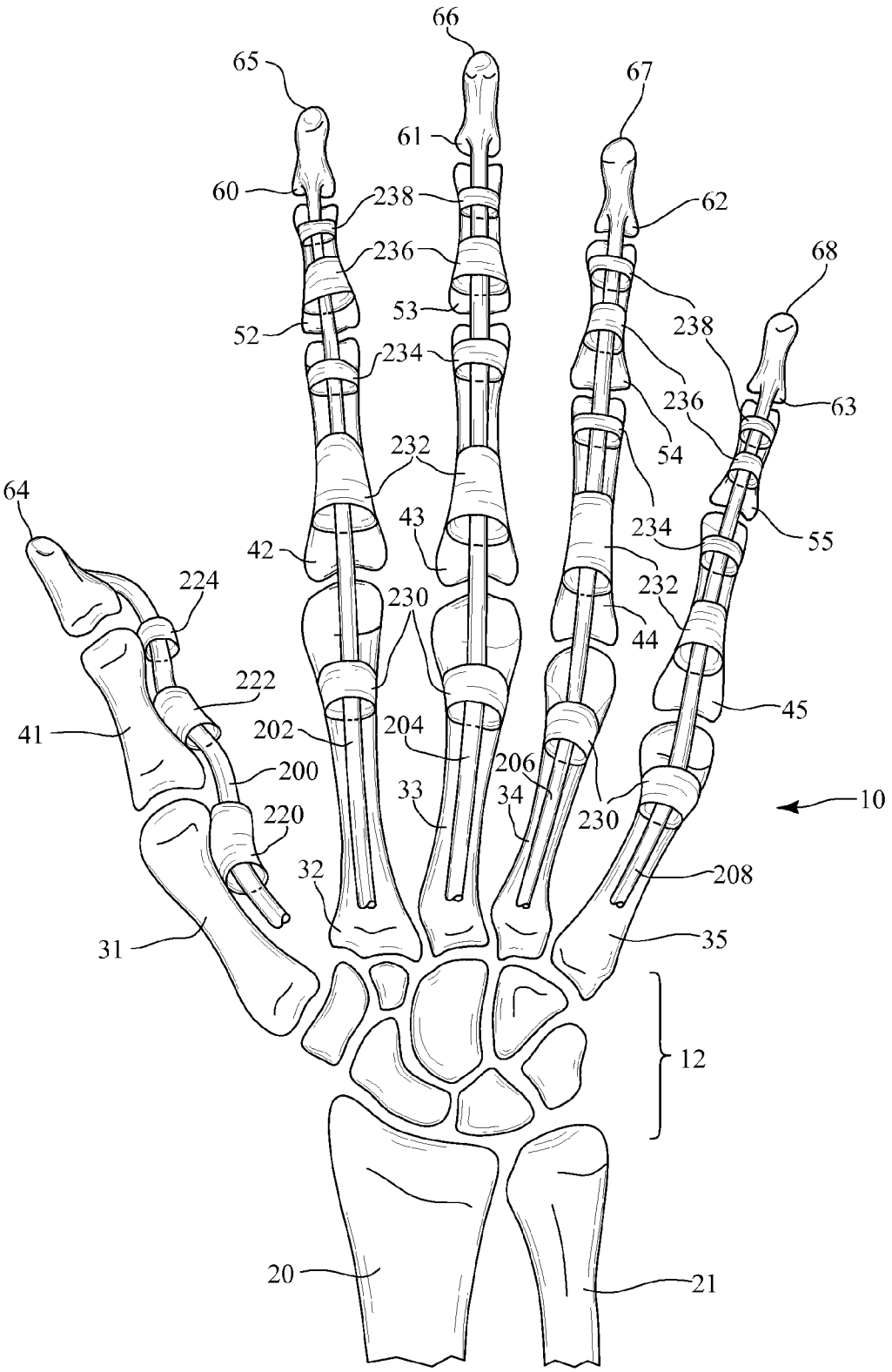
FIG. 2 is a bottom schematic anatomical palmar-side view of the bones, and selected details of the pulleys and tendons of a left side human hand.

FIG. 2 shows the skeletal anatomy, pulley system, and flexor tendons of the thumb 64 and fingers 65-68 of the right hand 10. The thumb 64 includes the flexor tendon (flexor pollicis longus) 200 and the three pulleys 220-224 of the thumb 64; an A1 pulley 220, A2 pulley 222, and A3 pulley 224. The A2 pulley 222 is the most important for function and is attached to the proximal phalanx 41 of the thumb 64. The respective pulleys 230-238 are also shown for each of the: index finger 65, long finger 66, ring finger 67, and small finger 68. Each finger 65-68 has five pulleys 230-238; an A1 pulley 230, A2 pulley 232, A3 pulley 234, A4 pulley 236, and A5 pulley 238. The A2 pulley 232 and A4 pulley 236 are considered to be the most important for function. The A2 pulley 232 is attached to the proximal phalanx 42-45. The A4 pulley 236 is attached to the middle phalanx 52-55. The A1 pulley 230 is near the MCP joint 37-40, the A3 pulley 234 is near the PIP joint 47-50 and the A5 pulley 238 is near the DIP joint 56-59.

Figure 5:
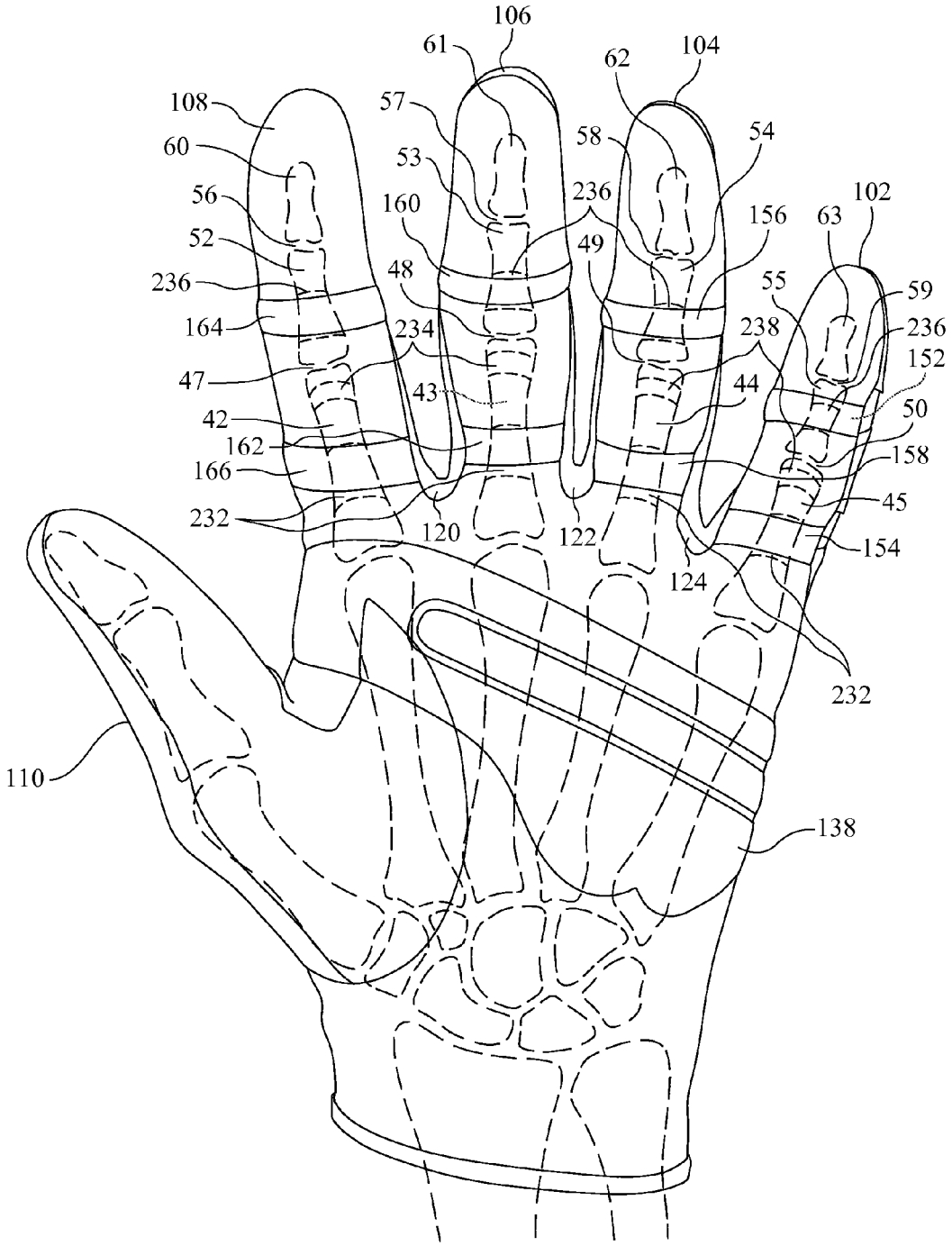
FIG. 5 is a palmar-side view of the glove of FIG. 4 showing the palmar side details and overlaying the skeletal structure of a left-palmar side human hand.

The flexor tendons 202-208 are shown as one unit for each finger 65-68, but actually there are two flexor tendons to each unit. They are the flexor digitorum superficialis and the flexor digitorum profundus (shown as one, 202-208). These tendons 202-208 travel underneath the pulleys 230-238 and the flexor digitorum profundus tendon attaches to the distal phalanx 60-63 of each finger 65-68. The tendons 202-208 move back and forth below the pulleys 230-238, via muscles (not shown) attached to the proximal end of the tendons. This movement of the tendon 202-208 produces finger 65-68 flexion. The pulleys 230-238 prevent the flexor tendons 202-208 from bowstringing or moving away from the bone with finger 65-68 flexion. If the pulleys 230-238 are damaged and no longer function, the tendons 202-208 may bowstring with a resultant significant loss of finger motion as well as grip strength. As such, pulleys 230-238, especially the A2 pulley 232 and the A4 pulley 236, are very important and must be preserved and protected as much as possible. As shown in FIG. 5, protective padding for each finger 65-68 is placed in an anatomically designed fashion over the A2 and A4 pulley regions. When the A2 and A4 pulleys 232 and 236 are preserved, adequate finger 65-68 motion and grip strength is maintained.

Figure 3:
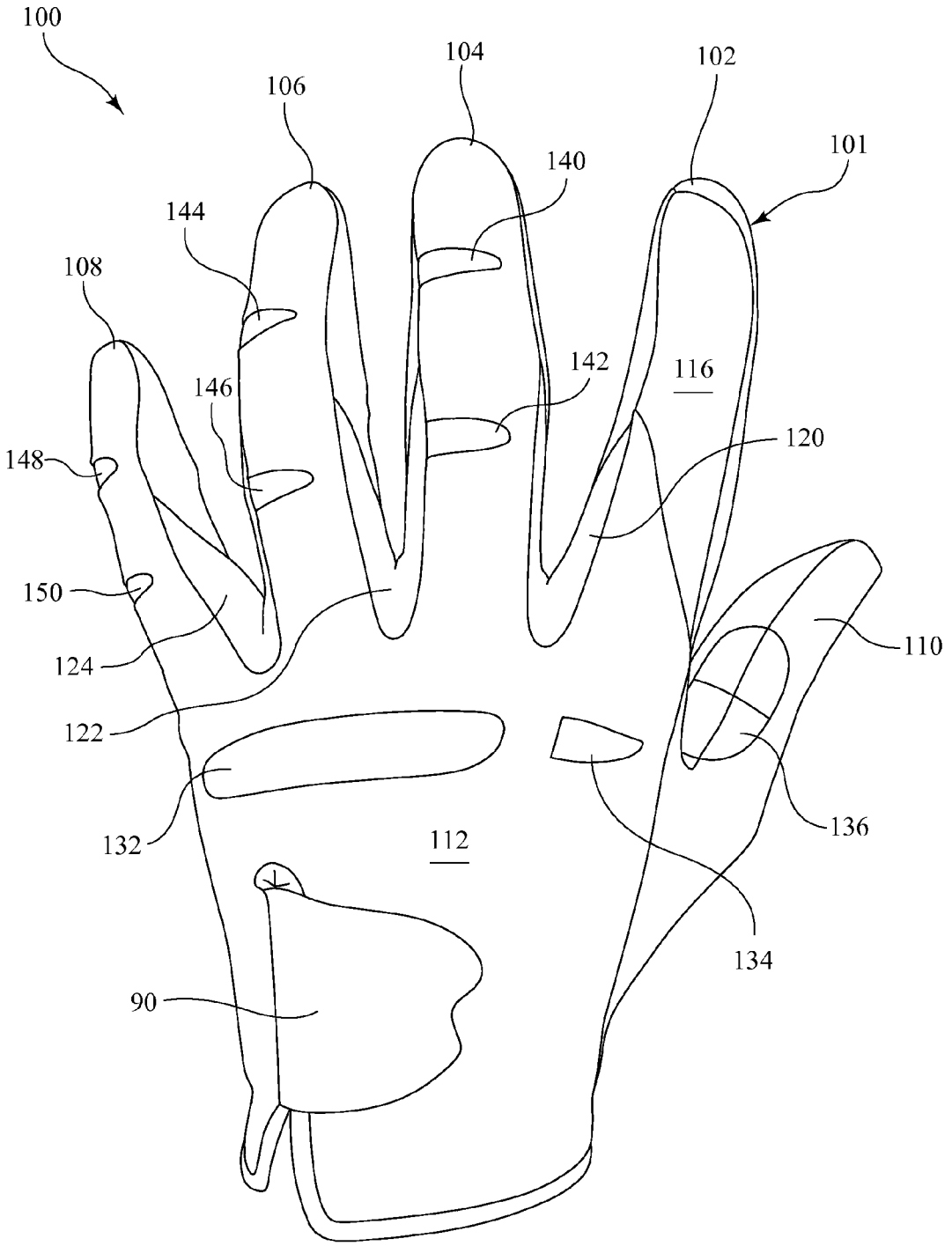
FIG. 3 is a top view of the one exemplary embodiment of the present invention.
Figure 4:
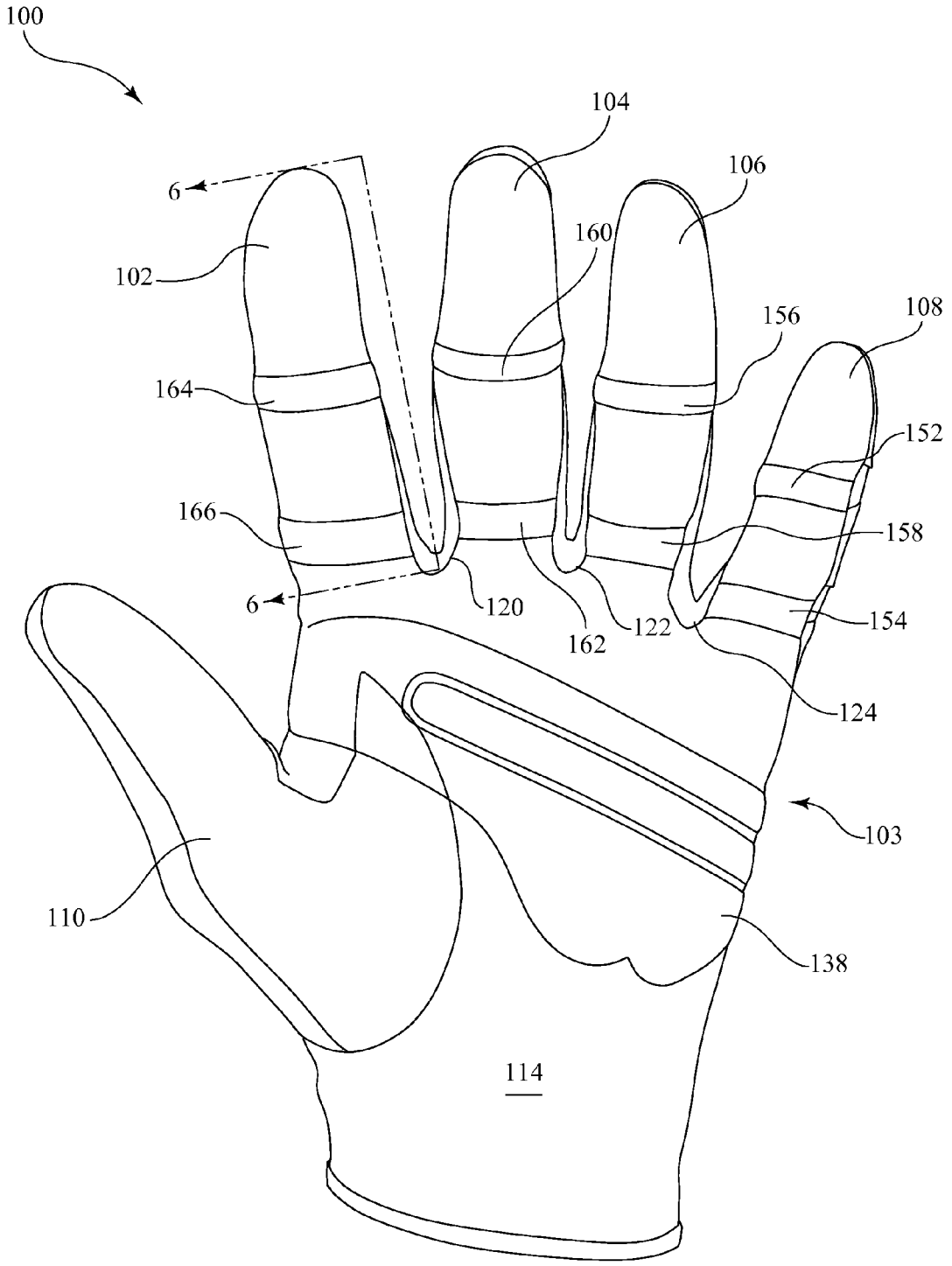
FIG. 4 is a bottom view of the glove of FIG. 3.

Referring now to FIGS. 3 and 4, an exemplary golf glove 100 is shown for a left human hand 10. Even though the glove 100 is shown for a left hand, it is realized that a glove for a right hand utilizes symmetrical placement of elements, materials, and the like as those shown for a left hand glove 100. In FIG. 3 is shown a dorsal side 101 of a golf glove 100 to cover a human hand 10 and FIG. 4 shows the palmar side 103 of the same glove. The glove 100 also includes finger stalls 102, 104, 106 and 108 to receive fingers 65, 66, 67 and 68, respectively therein. A thumb stall 110 is also provided to receive the thumb 64 therein.

The glove 100 is provided with a dorsal side covering or panel 112 for covering the back side or dorsal side 101 of the hand 10, as well as the dorsal sides of the thumb stall 110 and finger stalls 102, 104, 106, and 108. The dorsal side covering or panel 112 is usually a synthetic material such as, for example, JANEC SUPER® or leather or the like. Preferably, the dorsal side 101 is also provided with an expansion zone 132 which is positioned to cover the metacarpophalangeal joints of the small finger 68, the ring finger 67 and the long finger 66 (shown in FIG. 1) and an expansion zone 134 is positioned to cover the metacarpophalangeal joint 37 of the index finger. The expansion zones 132 and 134 are usually an elastomeric material, such as, for example, 2-way SPANDEX® or LYCRA®. Expansion zones 132, 134 in the area of the metacarpophalangeal joints of the hand 10 allows flexibility or movement of the joints when in use, such as for bending the fingers to grip a golf club. Moreover, padding 136 along the inside of the thumb may also be provided for comfort and shock absorbing protection when hitting a golf ball or the like. On the dorsal side 101 of the glove is also provided a fastening device, as illustrated by the numeral 90, which may be any fastening device, such as a hook and loop fastener, which is well known in the art.

Also provided in the web area of the glove 100 between the finger stalls 102, 104, 106, and 108 are gussets 120, 122 and 124, respectively, wherein gussets 120, 122, 124 extend along the inner sides of the stalls. The gussets 120, 122 and 124 generally include expansion materials, such as LYCRA® or the like. Expansion material may also be provided to cover the proximal interphalangeal joints 47-50 and the distal interphalangeal joints 56-59 of each of the fingers 65-68 which are received within the finger stalls 102, 104, 106 and 108. The elastomeric material disposed to cover the proximal interphalangeal joint 48 of the long finger 66 is identified by the numeral 142 whereas the elastomeric material to cover the proximal interphalangeal joint 49 of the ring finger 67 is identified by the numeral 146 and the elastomeric material for covering the proximal interphalangeal joint 50 of the small finger 68 is identified by the numeral 150. Similarly, elastomeric material 140 covers the distal interphalangeal joint 57 (FIG. 1) of the long finger 66, elastomeric material 144 covers the distal interphalangeal joint 58 (FIG. 1) of the ring finger 67 and the elastomeric material 148 covers the distal interphalangeal joint 59 (FIG. 1) of the small finger 68. The addition of the elastomeric materials at the aforementioned joints improves the flexibility of the fingers at these joints when gripping a golf club or the like. The golf glove 100 may also be provided with an elastomeric material, identified by the numeral 116, which extends along the index finger over the proximal interphalangeal joint 47 and the distal interphalangeal joint 56 of the index finger 65.

Referring now to FIG. 4, the palmar side of the glove is provided with a palmar side panel 114 which covers the palm side of a hand 10 as well as the finger elements to be received within the finger stalls 102, 104, 106 and 108, and the thumb stall 110. The palmar side 103 of the glove 100 may also include a shock absorbing pad 138 which extends across preselected portions of the palm area of the glove.

As best shown in FIG. 5, shock absorbing pads 154, 158, 162 and 166 are provided to protect and overlie the A2 pulleys 232 of the fingers 68, 67, 66 and 65. And, shock absorbing pads 152, 156, 160 and 164 are provided to protect and overlie the A4 pulleys 236 of the fingers 68, 67, 66 and 65. The shock absorbing pads 154, 158, 162, 166 covering the A2 pulleys of the proximal phalanxes 45, 44, 43 and 42 of the finger 68, 67, 66 and 65 terminate proximal to the proximal interphalangeal joints of the fingers. Moreover, the shock absorbing pads 152, 156, 160 and 164 covering the A4 pulleys are disposed between the proximal interphalangeal joint and the distal interphalangeal joints of the fingers with the proximal interphalangeal joints and the distal interphalangeal joints of the fingers being absent of shock absorbing padding.

Figure 6:
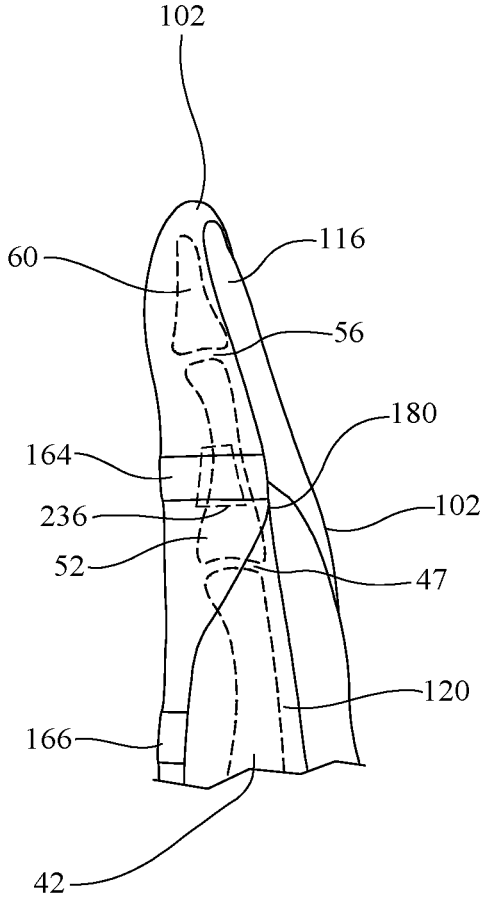
FIG. 6 is a sectional view taken along line 6-6 of FIG. 4 showing a selected location for a gusset of the glove of the present invention.

Gussets 120, 122 and 124 are disposed between the webs of the finger stalls 102, 104, 106 and 108 extend along the proximal phalanxes 42, 43, 44 and 45 and the middle phalanxes 52, 53, 54 and 55 with a terminating end between the proximal interphalangeal joints and the distal interphalangeal joints. And, as best shown in FIG. 6, the gusset 120 has a terminating end 180 along the middle phalanx 52 proximal to the shock absorbing pad 164. FIG. 6 shows the sectional view illustrating the terminating end of the gusset 120 along the inside of the index finger stall 102 and, the terminating end of the gussets along the other finger stalls 104, 106 and 108 terminate at substantially the same location. That is, the gussets extend along the phalanxes of each of the fingers terminating between the proximal interphalangeal joints and the distal interphalangeal joints. Moreover, the gussets 120, 122 and 124 terminate proximal to the A4 pulleys thereby allowing the glove to expand at the proximal interphalangeal joints providing for a snug fit and eliminate play of the fingers within the glove at the distal end of the fingers. Furthermore, as best illustrated in FIG. 6, by the positioning of the gusset 120 and the pad 164, the pad 164 wraps around the A4 pulley of the middle phalanx and fills in the "valley" between the proximal interphalangeal joint and the distal interphalangeal joints of the index finger, which assists in elimination of play at the distal end of the finger when holding a golf club or the like. As noted previously, even though only the gusset of the index finger has been shown in FIG. 6, it is realized that the gussets in the webs between the other finger stalls terminates along the middle phalanxes at substantially the same point and in combination with the shock absorbing pads 152, 156, and 160 also eliminates play in the other fingers when in a bent and use condition.

The foregoing detailed description is given primarily for clearness of understanding and no unnecessary limitations are to be understood therefrom for the modifications will become obvious for those skilled in the art upon reading this disclosure and may be made without departing from the spirit of the invention and scope of the appended claims.

What is claimed is:

1. A glove constructed to fit a hand of predetermined size for protecting selected and anatomical portions thereof comprising:

a palmar side panel and a dorsal side panel secured along each panel's outer periphery with an opening therein to receive a human hand, said dorsal side panel being sized to cover the back of said hand and said palmar side panel being sized to cover the palm of said hand, said dorsal side panel in conjunction with said palmar side panel providing a thumb stall and a plurality of finger stalls for receiving a thumb and fingers of a human hand;

a gusset in a web of the glove between adjacent finger stalls and extending along inner sides of said finger stalls, said gusset being tapered to terminate between a proximal interphalangeal joint and distal interphalangeal joint of fingers to be received in said adjacent finger stalls; and an expansion material covering at least one of a proximal interphalangeal joint and a distal phalangeal joint of said fingers.

2. The glove of claim 1 including a first gusset in the web of the glove between the finger stalls to receive an index finger and a long finger, a second gusset in the web between the finger stalls to receive a long finger and a ring finger, and a third gusset in the web between a ring finger and a small finger.

3. The glove of claim 1, said gusset being disposed along the A2 pulleys of said fingers to be received in said finger stall.

4. The glove of claim 1 including a shock absorbing pad to wrap around a middle phalanx of each of said fingers to be received in said finger stalls and terminating at said gusset.

5. The glove of claim 1, said finger stalls being a substantially pliable material.

6. The glove of claim 1 being leather or a synthetic material having substantially the same properties as leather.

7. The glove of claim 1, said gusset being an expandable material.

8. The glove of claim 1 wherein said finger stall of said index finger comprises elastomeric material extending over the proximal interphalangeal joint and the distal interphalangeal joint of said index finger.

* * * * *